US006369347B1

(12) United States Patent
Zhao et al.

(10) Patent No.: US 6,369,347 B1
(45) Date of Patent: Apr. 9, 2002

(54) ALUMINUM ALLOY SHEET FOR SPOT WELDING

(75) Inventors: Pizhi Zhao, Fuji; Takeshi Moriyama, Nagoya; Noboru Hayashi, Kawachi-gun; Kunihiro Yasunaga, Kanuma, all of (JP); Paul Wycliffe, Kingston; David James Lloyd, Bath, both of (CA)

(73) Assignees: Nippon Light Metal Company, Ltd. (JP); Alcan International Limited (CA); Honda Giken Kogyo Kabushiki Kaisha (JP)

( * ) Notice: Subject to any disclaimer, the term of this patent is extended or adjusted under 35 U.S.C. 154(b) by 0 days.

(21) Appl. No.: 09/508,174

(22) PCT Filed: Sep. 10, 1998

(86) PCT No.: PCT/JP98/04080

§ 371 Date: May 11, 2000

§ 102(e) Date: May 11, 2000

(87) PCT Pub. No.: WO99/13118

PCT Pub. Date: Mar. 18, 1999

(30) Foreign Application Priority Data

Sep. 11, 1997 (JP) ..... 9-246704

(51) Int. Cl.[7] ..... B23K 11/16
(52) U.S. Cl. ..... 219/118; 219/117.1
(58) Field of Search ..... 219/118, 117.1, 219/87, 86.1, 78.01; 148/526, 535

(56) References Cited

U.S. PATENT DOCUMENTS 3,751,626 A * 8/1973 Binger et al. ..... 219/117 R
5,409,156 A * 4/1995 Tsuji et al. ..... 228/120

FOREIGN PATENT DOCUMENTS

| | | | |
|---|---|---|---|
| EP | 0 681 034 A1 | | 11/1995 |
| JP | 3-90528 | | 4/1991 |
| JP | 4-272150 | | 9/1992 |
| JP | 4272150 | * | 9/1992 |
| JP | 4-325659 | | 11/1992 |
| JP | 5-5149 | | 1/1993 |
| JP | 5-302139 | | 11/1993 |

OTHER PUBLICATIONS

ASM specialty handbook Aluminum and aluminum alloys Editor Davis, Dec. 1993.*
Patent Abstracts of Japan, vol. 016, No. 455 (C–0987), Sep. 22, 1992 & JP 04 160130 A (Sky ALlum Co. Ltd), Jun. 3, 1992 Abstract.
Chemical Abstracts, vol. 117, No. 92, Oct. 19, 1919, Abstract No. 155836, Sasabe, Seiji et al.: "Lap resistance spot welding of aluminum or aluminum alloy sheets" XP002085696, abstract & JP 04 123879 A (Kobe Steel, Ltd., Japan).

* cited by examiner

*Primary Examiner*—M. Alexandra Elve
(74) *Attorney, Agent, or Firm*—Parkhurst & Wendel, L.L.P.

(57) ABSTRACT

An aluminum alloy sheet for automotive use is provided which comprises a starting aluminum alloy sheet which has an alloy composition containing from 2 to 6% by weight of Mg, 0.15 to 1.0% by weight of Fe and from 0.03 to 2.0% by weight Mn, and a surface layer disposed over one surface of the starting alloy sheet to be pressed against electrodes for use in welding, the surface layer containing a particulate intermetallic compound has a particle diameter of 0.5 $\mu$m or more and a density of 4,000 pieces of particles per one $mm^2$ or more. The product alloy sheet ensure least deformation of an electrode and stable weldability by means of continuous resistance spot welding.

12 Claims, No Drawings

ALUMINUM ALLOY SHEET FOR SPOT WELDING

TECHNICAL FIELD

The present invention relates to an aluminum alloy sheet that is suitably useful as a body sheet for automotive vehicles and is highly weldable by means of continuous resistance spot welding.

BACKGROUND ART

In automotive vehicles used as transport means, weight saving in respect of gravity has heretofore been taken as a target for development. This weight saving contributes greatly to increased transport quantity and hence reduced energy cost, and also to improved environmental protection.

Aluminum alloy materials are light in weight, good in formability and resistant to corrosion subject to surface treatment, and they offer high strength depending upon the chemical compositions and fabricating conditions. Thus, it has been proposed to substitute such an aluminum alloy for a steel sheet commonly accepted as an automobile body sheet, thereby making the finished automobile light in weight.

Products for general use such as automobiles have today been mass-produced as the advent of a certain production method with good efficiency. Namely, the body shape of an automotive vehicle is divided into a plurality of predetermined segments, followed by stamping of a body sheet matched with each such segment in order to prepare a stamped segment. The segment is then lapped in side-by-side relation to the mating adjoining segment, after which resistance spot welding is carried out. Repeated lapping and welding lead eventually to a complete automobile body. The resistance spot welding noted here is of an electric resistance type explained below in more detail. Electrode chips are used which are formed of a Cu alloy (also referred to hereunder as "electrodes"), and the lapped side portions of two stamped segments are firmly clamped between and pressed against the electrodes in tandem, followed by supply of a large capacity of current to the electrodes, so that a large amount of heat is generated out of the electrode in a short period of time. Thus, a hot melt pool or a nugget commonly called so is provided on a given surface of the lapped sides of the stamped segments, and ultimate solidification of the nugget brings about the two stamped segments welded on their respective sides. A production system designed to adopt this resistance spot welding is advantageous in that a production line is made feasible with automation.

Such production system is currently in common use for a conventional steel sheet since the latter is highly adaptable to resistance spot welding in continuous manner, say with a continuous run of 10,000 to 20,000 weld spots prior to the need for dressing of the electrode chip.

An aluminum alloy sheet of an Al—Mg series has been reputed as a substitute for the steel sheet recently. This alloy sheet is excellent in respect of corrosion resistance, strength and formability.

However, such aluminum alloy sheet is smaller in specific resistance and larger in thermal conductivity than a steel sheet, and besides is liable to suffer from seizing in operation with the corresponding electrode chip. This alloy sheet fails to warrant resistance spot welding with a continuous run of weld spots meeting with mass production.

In order to solve this problem or otherwise improve weldability by means of continuous resistance spot welding, there have been proposed several techniques. For instance, one such technique is directed to an aluminum alloy sheet containing Mg in an amount of from 0.5 to 6% by weight and having a specific resistance at 20° C. of 5.5 $\mu\Omega\cdot$cm or more (Japanese Unexamined Patent Publication No. 5-279781). Another technique is directed to a method in which an aluminum alloy sheet of an Al—Mg series or an Al—Mg—Si series is chemically etched on both of its surfaces to remove oxide films therefrom, followed by heating of the resulting alloy sheet in the atmosphere so as to form uniform oxide films on both sides (Japanese Unexamined Patent Publication No. 6-55280).

However, an electrode chip reacts on its surface with a portion of an aluminum alloy sheet to be exposed to resistance spot welding, eventually forming an adverse alloy layer thereon and moreover involving deformed tip of the electrode chip with the result that a current is difficult to be applied at a stable value, and hence, resistance spot welding is difficult to be continuously conducted. These difficulties cannot be satisfactorily obviated even with reliance upon the techniques cited above.

DISCLOSURE OF INVENTION

Continued research leading to the present invention, the present inventors have found that an electrode chip on its surface can be made difficult to form an alloy layer which would arise from reaction of Cu of the electrode with an aluminum alloy sheet to be subjected to resistance spot welding, particularly in the case where the density of a particulate intermetallic compound is preset at a specific value. The compound is defined as existing in one surface layer of such alloy sheet to be pressed against the electrode.

One principal object of the invention, therefore, lies in the provision of an aluminum alloy sheet for automotive use that exhibits stable weldability by means of continuous resistance spot welding with rather a small likelihood of the tip of an electrode chip becoming deformed.

More specifically, the invention provides an aluminum alloy sheet for use in an automobile body sheet having excellent weldability by means of continuous resistance spot welding, which comprises a starting aluminum alloy sheet which has an alloy composition containing from 2 to 6% by weight of Mg, 0.15 to 1.0% by weight of Fe and from 0.03 to 2.0% by weight of Mn, and the rest of which balanced up with an aluminum and unavoidable contaminants; and a surface layer disposed over one surface of the starting aluminum alloy sheet to be pressed against electrodes for use in spot welding, the surface layer containing a particulate intermetallic compound which has a particle diameter of 0.5 $\mu$m or more and a density of 4,000 pieces of particles per one mm$^2$ or more.

BEST MODE FOR CARRYING OUT THE INVENTION

The aluminum alloy sheet having the above specified composition shows a rise in electric resistance and, even with a small supply of current when in initiating resistance spot welding, can generate a large heat at the lapped side portions of two such alloy sheets to be subjected to spot welding with consequential formation of a desirable nugget between the alloy sheets. Additionally, a lot of particulate intermetallic compounds are formed due to the presence of Fe and Mn in the aluminum alloy sheet. A particulate intermetallic compound of 0.5 $\mu$m or more in particle diameter is allowed to exist in a high density in a surface layer of the aluminum alloy sheet. This leads to least formation of an alloy layer between the electrode and the alloy sheet, and hence, results in reducing the alloy layer on the electrode surface, and also to least deformation of the electrode tip, ultimately permitting a stable continuous operation of resistance spot welding. If the particulate intermetallic compound were present in too small a content in the surface layer on the aluminum alloy sheet, then an alloy layer would take place in a greater extent on the electrode surface, resulting in deformed tip of the electrode chip with eventual failure to effect resistance spot welding in a stably continuous fashion.

The aluminum alloy sheet is pressed, against the electrode, on its surface layer in which the particulate intermetallic compound is contained as stated above. It is desired that such surface layer be made to have a depth or thickness of 20 $\mu$m or more as determined from its outer surface. A depth or thickness of 20 $\mu$m or more could render the resultant particulate intermetallic compound containing surface layer sufficiently thick even upon pressing against the electrode, thus avoiding an alloy layer from getting formed between the electrode and the aluminum alloy sheet. Smaller thickness than 20 $\mu$m would be liable to frequently produce an objectionable alloy layer.

Moreover, the oxide film should desirably have a thickness in the range of from 0.04 to 0.2 $\mu$m. The film is disposed on one surface of the alloy sheet to be pressed against the electrode. This requirement exerts, in addition to the above stated advantages, further protection against alloying between the electrode and the aluminum alloy sheet when in conducting resistance spot welding, and further improvement in continuous weld spotting. Below 0.04 $\mu$m in oxide film thickness would produce no significant results. Conversely, above 0.2 $\mu$m in similar thickness would invite too great a contact resistance between the electrode and the alloy sheet and hence an excessive heat, ultimately causing seized electrode chip and unstabilized spot weldability.

The present invention will now be described in greater detail with reference to one preferred embodiment of the aluminum alloy sheet that is useful for automotive vehicles and weldable by means of continuous resistance spot welding.

In accordance with this embodiment, the aluminum alloy sheet comprises a starting aluminum alloy sheet which has an alloy composition containing from 2 to 6% by weight of Mg, 0. 15 to 1.0% by weight of Fe and from 0.03 to 2.0% by weight of Mn, and a surface layer disposed over one surface of the starting aluminum alloy sheet to be pressed against electrodes for use in spot welding, the surface layer containing a particulate intermetallic compound which has a particle diameter 0.5 $\mu$m or more and a density of 4,000 pieces of particles per one $mm^2$ or more. Desirably, such surface layer should be set to have a thickness of 20 $\mu$m or more as determined from its outer surface. Besides and desirably, the oxide film should have a thickness in the range of from 0.04 to 0.2 $\mu$m, this oxide film being disposed directly over one surface of the alloy sheet to be exposed to pressing against the electrode.

Firstly, the above alloy composition is explained.

Mg: 2 to 6% by weight

Mg has a role to impart strength to aluminum for suitability as an automobile body sheet, and to cause a great electric resistance and a large heat to generate on an alloy sheet even with a small supply of applied current when in effecting resistance spot welding, thus enabling simplified formation of a nugget and improved weldability of resistance spot welding. Less than the lower limit of 2% by weight would fail to bring about sufficient results. More than the upper limit of 6% by weight would give rise too great a strength for forming of the resultant alloy sheet during rolling, bending and so on, and also would render the alloy sheet highly susceptible to stress corrosion cracking. In consequence, stabilized quality cannot be maintained for a prolonged period of time. The content of Mg, therefore, should be in the range of from 2 to 6% by weight.

Fe: 0.15 to 1.0% by weight

Fe acts to form various particulate intermetallic compounds resulting from incorporation of Fe in aluminum (intermetallic compounds such as Al—Fe, Al—Fe—Mn and so on), thereby avoiding an alloying reaction between the electrode and the alloy sheet while in resistance spot welding, and this ensures stable weldability by means of continuous resistance spot welding. Contents of less than the lower limit of 0.15% by weight would fail to form the above particulate intermetallic compounds in a sufficient number, ultimately revealing no significance in adding Fe, and inviting poor weldability by means of continuous resistance spot welding. Contents of more than the upper limit of 1.0% by weight would produce a coarse particulate intermetallic compound containing the Fe element, thus making it difficult to form the resulting alloy sheet as by bending or the like. Hence, the content of Fe should be in the range of from 0.15 to 1.0% by weight.

Mn: 0.03 to 2.0% by weight

Mn cooperates with Mg in allowing a great electric resistance and a large heat to generate on an alloy sheet even in the case of a small supply of applied current when in effecting resistance spot welding, thus enabling simplified nugget formation and improved weldability by means of continuous resistance spot welding. Smaller contents than 0.03% by weight would bear no good results, whereas larger contents than 2.0% by weight would lead to coarse intermetallic compounds during casting with eventual decline in formability. Hence, the content of Mn should be in the range of from 0.03 to 2.0% by weight.

The aluminum alloy sheet according to the present invention is comprised of the alloy composition specified above. Accordingly, this alloy sheet affords as great a specific resistance as approximately 5.8 $\mu\Omega\cdot$cm, forming a desirable nugget between the lapped side portions of two sheet segments to be subjected to resistance spot welding even with a limited quantity of current applied. Namely, even when resistance spot welding is effected with specific resistance provided to a great extent, but with power current supplied to a small extent, a large heat is generated in the whole of the lapped portions to be welded with the result that a nugget is obtained as desired. Less than 5.8 $\mu\Omega\cdot$cm in specific resistance would be responsible for insufficient heat and hence for difficult formation of a nugget between the lapped side portions of two sheet segments to be exposed to resistance spot welding.

On the other hand, in the case of application of a power current in providing a nugget, heat is generated between the electrode and the alloy sheet so that an alloy layer is formed on the electrode by cooperation with the alloy sheet, while the electrode is distorted. This in turn leads to varied area of contact between the electrode and the alloy sheet, resulting in the variation of current density with ultimate failure to attain stable resistance spot welding. In such case, the spot welding operation is required for shutdown so as to conduct replacement of electrodes or dressing of the electrode chip.

The aluminum alloy sheet of the present invention contains Fe and Mn that forms a particulate intermetallic compound The compound has a particle diameter of 0.5 μm or more and a density of 4,000 pieces of particles/mm$^2$ or more. The intermetallic compound serves to disturb any likelihood of Cu of the electrode reacting with the alloy sheet, thus preventing both the electrode Cu and the alloy sheet from getting alloyed. 7,000 pieces/mm$^2$ or more in a density may be further desired in avoiding such alloying. If the intermetallic compound having a relatively large particle diameter of 0.5 μm or more in particle diameter is less than 4,000 pieces of particles/mm$^2$ in a density, then the electrode Cu would form thereon a greater alloy layer, eventually posing distorted electrode chip and hampering stable resistance spot welding.

Furthermore, it is ensured that alloying be avoided between the electrode and the aluminum alloy sheet. Provided that the particulate intermetallic compound of 0.5 μm or more in particle diameter is made present in a density of 4,000 pieces of particles/mm$^2$ or more, and in a depth or thickness of 20 μm or more as determined from such an alloy sheet surface that the alloy sheet is allowed to contact with or otherwise press against the electrode.

The density of the particulate intermetallic compound can be measured as a number of particles in a specific area by means of an image analyzer (LUZEXF, Product of Nileco Co.). According to this mode of measurement, particulate intermetallic compounds such as $Mg_2Si$ but devoid of Fe and Mn are simultaneously measured. Hence, a reading of 4,000 pieces of particles/mm$^2$ or more on that analyzer indicates particulate intermetallic compounds, a greater part of which is regarded as a particulate intermetallic compound containing Fe and Mn contemplated under the present invention and serving to prevent alloying between the electrode and the aluminum alloy sheet. The number of the particulate intermetallic compound used herein is determined by selectively counting those particles sized to be 0.5 μm or more.

The foregoing image analyzer is designed to measure the area of a particle and to then convert the measured area into a circular diametrical one. The resulting diameter is taken as the particle diameter used herein.

In the embodiment described above, an oxide film is formed directly over one surface of the aluminum alloy sheet to be pressed against the electrode. The oxide film should have a thickness in the range of from 0.04 to 0.2 μm. This specific film ensures precluding alloying between the electrode and the sheet while in resistance spot welding, optimizing heat generation at a portion to be spot-welded between the electrode and the sheet, avoiding seizing of the electrode chip, and improving continuous weld spotting. Smaller thickness of the oxide film than 0.04 μm would be ineffective in attaining the above mentioned results. Larger thickness than 0.2 μm would involve too great a contact resistance between the electrode and the sheet, hence an excessive heat, ultimately causing seized electrode chip and reduced weld spotting in stable continuous manner.

In this embodiment, the aluminum alloy sheet has an alloy composition comprising as essential elements Mg, Fe and Mn. Such composition is sufficient to gain the above advantages and to provide an aluminum alloy sheet that is useful for automotive vehicles and excellent in resistance spot weldability in continuous condition. When it is found desirable, alloy elements other than the three specified elements may be added so that the finished aluminum alloy sheet is capable of exhibiting, in addition to the above noted advantages, those characteristics peculiar to additional alloy elements used.

For instance, when Cu is incorporated in a content of more than 0.005% by weight in the three elements specified above, an aluminum alloy sheet can be obtained with greater strength exerted by alloying of aluminum and with higher resistance to stress corrosion cracking. Contents of Cu exceeding 0.5% by weight, however, would show a decline in corrosion resistance. Additionally, at least one element of Cr in a content of from 0.02 to 0.15% by weight, Zr in a content of from 0.02 to 0.15% by weight and V in a content of from 0.02 to 0.10% by weight may be added where needed since the resultant recrystalline grains are rendered minute with improved strength. To prevent cracking during casting, as commonly practiced in the art, Ti in a content of from 0.005 to 0.2% by weight and B in a content of from 0.001 to 0.1% by weight may be used alone or in combination. Zn in a content of 0.5% or less by weight and Si in a content of 0.2% or less by weight might also be caused to intrude, from remelt ingots, return scrap and machine tools used, into the resultant aluminum alloy sheet.

The aluminum alloy sheet thus composed can be produced for example by continuously casting molten aluminum alloy of a given composition into a slab of from 5 to 30 mm in thickness with use of a continuous casting method such as a twin-roll casting method, a belt-casting method, a 3C method or the like, by cold-rolling the slab to the sheet, after hot rolling when necessary, and subsequently by annealing the sheet at a temperature of from 300 to 550° C. during and/or after cold rolling. This annealing may be done with a slower heating rate of about 40 ° C./hr or with a heating rate of 1° C./sec or more. Holding time may be from about 10 minutes to about 5 hours at a temperature of from 300 to 450° C. in the slow heating rate, and from about 1 second to about 10 minutes at a temperature of from 450 to 550° C. in the faster heating late. Needless to say, a slab derived from semi-continuous casting may be exposed, without scalping, to hot rolling and cold rolling in known manner.

The aluminum alloy sheet so produced is subjected to resistance spot welding in continuous condition. Eligible spot welding conditions may be selectively determinable. Those conditions based on use of a copper alloy electrode are explained here. That is, two stamped segments are lapped on their mating sides, and clamped and pressed at a clamp force of from 3 to 13 kN, preferably from 4 to 13 kN, by use of electrodes disposed in tandem, followed by supply of a current of from 20 to 50 kA for from 0.001 to 0.5 second. Thus, a desirable nugget is formed so that resistance spot welding can be continuously effected.

EXAMPLES

The aluminum alloy sheet for automotive use according to the present invention is further illustrated with regard to several examples shown in Tables 1 to 3.

In these examples and the associated tables, all percentages are indicated on a weight basis unless otherwise noted.

Table 1 lists the chemical compositions of the inventive aluminum alloy sheets and of the comparative equivalents. Six alloy sheets of alloy 1 to alloy 6 were produced as the inventive examples and three alloy sheets of alloy 7 to alloy 9 as the comparative examples. Zn was analyzed to be 0.001% and Si to be 0.07% as main impurities in the chemical compositions of the aluminum alloys tabulated.

Table 2 represents the fabricating conditions of the inventive aluminum alloy sheets and of the comparative equivalents. Six alloy sheets of fabrication number i to vi were fabricated as the inventive examples and four alloy sheets of vii to x as the comparative examples. Of the inventive alloy sheet specimens, some specimens were fabricated by continuously casting molten aluminum alloy into a slab of each thickness tabulated, immediately followed by hot rolling of the slab and by subsequent cold rolling and final annealing (fabrication No. i, ii, iv, v and vi), and one specimen was fabricated through continuous casting and subsequent cold rolling and final annealing with hot rolling omitted (fabrication No. iii). The final annealing was conducted by faster heating rate to 500° C., by holding time for 2 seconds, and by cooling at a rate of 40 ° C./sec.

Among the comparative aluminum alloy sheet specimens, one specimen was fabricated by scalping a slab obtained from semi-continuous casting (DC), followed by soaking of the slab and by subsequent hotrolling, cold rolling and final annealing (fabrication No. vii), and some specimens were fabricated through continuous casting, hot rolling and cold rolling, and also final annealing as in the inventive specimens (fabrication No. viii, ix and x). In the comparative specimens, the same analyses as in the inventive specimens were obtained as to main impurities in the chemical compositions of the alloys tabulated.

Table 3 lists the characteristics of the specimens provided from the alloys of the chemical compositions of Table 1 combined with the fabricating conditions of Table 2, along with the results obtained by the testing. Nine tests (A to I) were run as the inventive example and four tests (J to M) as the comparative examples. After measurement of the various characteristics of the specimens provided under the above set of conditions, resistance spot welding was carried out in continuous manner. The densities of particulate intermetallic compounds were measured by use of an image analyzer and the thickness of oxide films by means of Auger electron spectroscopy. That density was determined at a depth of 20 $\mu$m of the alloy sheet from its surface layer. As regards both of the inventive and comparative examples, the oxide films were measured by a XMA mapping method, and it has been found that Mg is held in uniformly distributed condition with an oxide of Mg uniformly formed as a whole. Weld conditions were from 20 to 22 kA in weld current, 28 mm$^2$ in area of contact between the electrode and the sheet, and 4 kN in clamp force.

The test results were given in Table 3 in the columns of continuous weld spotting and weldability. The weldability was adjudged by three symbols of "○○", "○" and "×" which were ranked to be superior in this order. Continuous weld spotting of 700 spots or above has been gained in the inventive alloy sheets of Inventive Examples A to C which meet with the chemical compositions of alloys and the densities of intermetallic compounds according to the present invention. Continuous weld spotting of larger than 900 spots has been revealed in the inventive alloy sheets of Inventive Examples D to I which fall within the scope of the invention in regard to the thickness of oxide films on the alloy sheets. As is evident from Comparative Examples J to M, departures of either one of the requirements within the invention are responsible for small spots of continuous weld spotting, hence for unsatisfactory weldability by means of continuous resistance spot welding.

TABLE 1

Chemical Compositions of Alloys

| Example | Alloy No. | Mg | Fe | Mn | Cu | Cr | Ti | B |
|---|---|---|---|---|---|---|---|---|
| Inventive Example | 1 | 4.5 | 0.23 | 2.24 | 0.04 | — | 0.02 | — |
| | 2 | 4.5 | 0.23 | 0.05 | 0.04 | 0.15 | 0.02 | — |
| | 3 | 2.5 | 0.24 | 1.50 | 0.04 | — | 0.01 | 0.005 |
| | 4 | 4.5 | 0.9 | 0.35 | 0.04 | — | 0.01 | 0.005 |
| | 5 | 4.5 | 0.23 | 0.24 | 0.05 | — | — | — |
| | 6 | 4.5 | 0.23 | 0.05 | 0.40 | — | 0.01 | 0.005 |
| Comparative Example | 7 | 4.5 | 0.05 | 0.24 | 0.04 | — | — | — |
| | 8 | 4.5 | 0.05 | 0.01 | 0.04 | — | 0.05 | — |
| | 9 | 1.0 | 0.24 | 1.00 | 0.04 | — | 0.02 | 0.005 |

(% by weight)

TABLE 2

Fabricating Conditions of Alloy Sheets

| Example | Fabrication No. | Alloy No. | Casting method/slab thickness (mm) | Scalping | Soaking | Thickness after hot rolling (mm) | Thickness after cold rolling (mm) | Final annealing temp. (° C.) |
|---|---|---|---|---|---|---|---|---|
| Inventive Example | i | 1 | Continuous casting/25 | no | no | 6.0 | 1.0 | 500 |
| | ii | 2 | Continuous casting/25 | no | no | 6.0 | 1.0 | 500 |
| | iii | 3 | Continuous casting/6 | no | no | — | 1.0 | 500 |
| | iv | 4 | Continuous casting/25 | no | no | 6.0 | 1.0 | 500 |
| | v | 5 | Continuous casting/25 | no | no | 6.0 | 1.0 | 500 |
| | vi | 6 | Continuous casting/25 | no | no | 6.0 | 1.0 | 500 |
| Comparative Example | vii | 1 | DC/508 | yes 5 mm | yes | 6.0 | 1.0 | 500 |
| | viii | 7 | Continuous casting/25 | no | no | 6.0 | 1.0 | 500 |
| | ix | 8 | Continuous casting/25 | no | no | 6.0 | 1.0 | 500 |
| | x | 9 | Continuous casting/25 | no | no | 6.0 | 1.0 | 500 |

TABLE 3

Characteristics and Results of Specimens

| Example | Test No. | Fabrication No. | Alloy No. | Pickling | Inter-metallic compound density (piece/mm$^2$) | oxide film thickness ($\mu$m) | Specific resistance ($\mu\Omega \cdot$ cm) | continuous weld spotting | Weld-ability | Remark |
|---|---|---|---|---|---|---|---|---|---|---|
| Inventive Example | A | i | 1 | yes | 7100 | 0.020 | 5.8 | 700 | ○ | Claim 1 |
| | B | iii | 3 | yes | 8500 | 0.020 | 6.0 | 790 | ○ | |
| | C | iv | 4 | yes | 9050 | 0.018 | 5.9 | 815 | ○ | |
| | D | i | 1 | no | 7100 | 0.105 | 5.8 | 1450 | ○○ | Claim 3 |
| | E | ii | 2 | no | 7150 | 0.090 | 5.8 | 960 | ○○ | |
| | F | iii | 3 | no | 8500 | 0.100 | 6.0 | 920 | ○○ | |
| | G | iv | 4 | no | 9050 | 0.095 | 5.9 | 990 | ○○ | |
| | H | v | 5 | no | 7215 | 0.102 | 5.8 | 1300 | ○○ | |
| | I | vi | 6 | no | 7110 | 0.120 | 5.8 | 1100 | ○○ | |
| Comp. Example | J | vii | 1 | no | 3854 | 0.100 | 5.7 | 400 | × | |
| | K | viii | 7 | no | 3500 | 0.09 | 5.7 | 350 | × | |
| | L | ix | 8 | no | 3800 | 0.100 | 5.3 | 450 | × | |
| | M | x | 9 | no | 7105 | 0.080 | 5.0 | 300 | × | |

weldability is ranked progressively from good to bad in the following order: ○○, ○, ×

The aluminum alloy sheet for automotive use according to the present invention ensures least deformation of the tip of an electrode chip and excellent weldability by means of continuous resistance spot welding. Consequently, upon assembly of this alloy sheet as an automobile body sheet, productivity can be enhanced with least frequency of electrode replacements or electrode dressings.

Additionally, the oxide film on a slab can be used to advantage without the need for removal with eventual further improvement in weldability by means of continuous resistance spot welding. The alloy sheet is greatly conducive to save weight of the finished automotive vehicle and hence is industrially significant.

What is claimed is:

1. An aluminum alloy sheet for use in an automobile body sheet having excellent weldability by means of resistance spot welding, said sheet comprising a starting aluminum alloy sheet having an alloy composition containing from 2 to 6% by weight of Mg, from 0.15 to 1.0% by weight of Fe, from 0.03 to 2.0% by weight of Mn, the rest of which constituted by aluminum and unavoidable contaminants; and a surface layer disposed over one surface of the starting aluminum alloy sheet to be pressed against electrodes for use in welding, the surface layer containing a particulate inter-metallic compound having a particle diameter of at least 0.5 $\mu$m and a density of at least 7,000 particles/mm$^2$.

2. An aluminum alloy sheet according to claim 1, wherein the starting aluminum alloy sheet further contains 0.005 to 0.5% by weight of Cu.

3. An aluminum alloy sheet according to claim 1, wherein the starting aluminum alloy sheet further contains at least one of 0.02 to 0.15% by weight of Cr, 0.02 to 0.15% by weight of Zr and 0.02 to 0.10% by weight of V.

4. An aluminum alloy sheet according to claim 1, wherein the starting aluminum alloy sheet alloy further contains one or both of 0.005 to 0.2% by weight of Ti and 0.001 to 0.1% by weight of B.

5. An aluminum alloy sheet according to claim 1, wherein the surface layer has a thickness of at least 20 $\mu$m.

6. An aluminum alloy sheet according to claim 1, further comprising an oxide film disposed directly over said one surface of the starting aluminum alloy sheet, said oxide film having a thickness of 0.04 to 0.2 $\mu$m.

7. An automobile body sheet comprising a plurality of segments formed by an aluminum alloy sheet, wherein the segment is welded with the mating adjoining segment by means of resistance spot welding; and the aluminum alloy sheet comprises a starting aluminum alloy sheet having an alloy composition containing from 2 to 6% by weight of Mg, from 0.15 to 1.0% by weight of Fe, from 0.03 to 2.0% by weight of Mn, the rest of which constituted by aluminum and unavoidable contaminants, and a surface layer disposed over one surface of the starting aluminum alloy sheet to be pressed against electrodes for use in welding, the surface layer containing a particulate inter-metallic compound having a particle diameter of at least 0.5 $\mu$m and a density of at least 7,000 particles/mm$^2$.

8. An automobile body sheet according to claim 7, wherein the starting aluminum alloy sheet further contains 0.005 to 0.5% by weight of Cu.

9. An automobile body sheet according to claim 7, wherein the starting aluminum alloy sheet further contains at least one of 0.02 to 0.15% by weight of Cr, 0.02 to 0.15% by weight of Zr and 0.02 to 0.10% by weight of V.

10. An automobile body sheet according to claim 7, wherein the starting aluminum alloy sheet alloy further contains one or both of 0.005 to 0.2% by weight of Ti and 0.001 to 0.1% by weight of B.

11. An automobile body sheet according to claim 7, wherein the surface layer has a thickness of at least 20 $\mu$m.

12. An automobile body sheet according to claim 7, further comprising an oxide film disposed directly over the one surface of the starting aluminum alloy sheet, said oxide film having a thickness of 0.04 to 0.2 $\mu$m.

* * * * *